United States Patent [19]

Kōda

[11] 4,029,382

[45] June 14, 1977

[54] WATERTIGHT MEANS FOR ELECTRIC PLUG-RECEPTACLE COUPLING

[75] Inventor: Yosiharu Kōda, Tokyo, Japan

[73] Assignee: Denkosha Co., Ltd., Tokyo, Japan

[22] Filed: Nov. 28, 1975

[21] Appl. No.: 635,878

[30] Foreign Application Priority Data

Dec. 9, 1974 Japan ..... 49-140448

[52] U.S. Cl. ..... 339/94 M

[51] Int. Cl.[2] ..... H01R 19/60

[58] Field of Search ..... 339/36–38, 339/114, 94 R, 94 C, 94 M, 116 R, 116 C

[56] References Cited

UNITED STATES PATENTS

| | | | |
|---|---|---|---|
| 3,182,280 | 5/1965 | Daut et al. | 339/38 X |
| 3,621,448 | 11/1971 | Arnold et al. | 339/94 M |
| 3,792,416 | 2/1974 | Moulin | 339/94 R |
| 3,976,352 | 8/1976 | Spinner | 339/94 R X |

*Primary Examiner*—Roy Lake
*Assistant Examiner*—E. F. Desmond
*Attorney, Agent, or Firm*—Kurt Kelman

[57] ABSTRACT

A tubular packing with a flexible flange means is disposed along the surface where an electric plug mates with a receptacle. When mated, the flange means flexes for ensuring watertightness at the plug-receptacle coupling.

4 Claims, 4 Drawing Figures

WATERTIGHT MEANS FOR ELECTRIC PLUG-RECEPTACLE COUPLING

BACKGROUND OF THE INVENTION

1. Field of the Invention

This invention relates to a means which, when a plug mates with a receptacle, prevents outside water from entering into the coupling between the plug and the receptacle.

2. Description of the Prior Art

In a typical structure of currently used watertight plugs and receptacles for an electric connection, a threaded lock portion is formed along the outer periphery of the plug-receiving portion of the receptacle, and a threaded metallic lock member is mounted on the body portion of the plug so as to turned about the axis of the body portion, and a packing is mounted within the plug so as to surround plug-blades and to extend in the direction of said axis at right angles to the plug-blades. After the plug-blades are inserted in the receptacle, the metallic lock member is turned for making the plug-receptacle coupling watertight. This conventional structure has a shortcoming in that, if the metallic lock member is not fully tightened, reliable watertightness of the plug-receptacle coupling cannot be ensured, and that, if a blind cover is to be mounted when the plug-receptacle coupling is not used, the mounting of such blind cover becomes complicated.

In another structure of conventional watertight plugs and receptacles, a packing acting as a watertight belt is disposed between the outer periphery of the support portion of a plug and the inner periphery of the plug-receiving support portion of a receptacle, so that when the plug mates with the receptacle, the packing tightly engages both of the two support portions for providing watertightness. This structure provides comparatively good watertightness, but the two support portions are difficult to couple and separate, and if the coupling is loose, the capillary phenomenon takes place between the packing and the contact surface of the support portions, so that the degree of watertightness is reduced. On the other hand, to achieve high watertightness, the two support portions must be tightly coupled, which tight coupling is difficult to make, and the two support portions coupled at a high watertightness are susceptible to accidental separation by the pressure of air trapped therebetween when the plug-receptacle coupling is vibrated. Thus, there is a shortcoming in that the separability of the two support portions depends on the degree of watertightness.

OBJECT

An object of the present invention is to provide a watertight means for the coupled portion between an electric plug and a receptacle therefor by using a tubular flanged packing, which packing is disposed on a surface wherein the support portion of a receptacle mates with the support portion of a plug.

Another object of the present invention is to provide a watertight means which ensures plug-receptacle coupling within a predetermined degree of tightness at the aforesaid coupled portion, by using the aforesaid tubular flanged packing.

Another object of the present invention is to provide a watertight means, with which the plug-receptacle coupling within the aforesaid tightness degree range can be easily established and yet arbitrary separation of the plug from the receptable is effectively prevented.

DETAILED DESCRIPTION OF THE DRAWINGS

Figure 1:
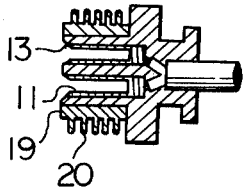
FIG. 1 is a sectional view, illustrating a plug-receiver and a support thereof, which support is provided with a watertight means according to the present invention.

In FIG. 1, a tubular packing 19 is secured, by adhesive, to the outer periphery of a support 13 of plug-receivers 11 so as to surround the support. Annular flanges 20 are integrally formed with the tubular packing 19 so as to extend outwardly from the outer periphery thereof at right angles thereto.

Dimensions of test specimens of the tubular packing 19 and the flanges 20 are shown in Table 1, together with the results of tests Table 1

| Specimen No. | Flange dimension: Height (mm) | Flange dimension: Thickness (mm) | Flange dimension: Number of flanges | Inter-flange spacing (mm) | Flange material, hardness of isobutylene-isoprene rubber | Flange height as coupled (mm) | Water leakage test result: Water depth (cm) | Water leakage test result: Dipping time (hr) | Water leakage test result: Water leakage |
|---|---|---|---|---|---|---|---|---|---|
| 1 | 2.5 | 0.8 | 5 | 1.0 | 40° | 2.30 | 10 | 75 | None |
| 2 | 2.5 | 0.8 | 6 | 0.6 | 50° | 2.35 | | | |
| 3 | 2.5 | 0.8 | 3 | 1.0 | 40° | 2.35 | 10 | 24 | None |
| | | | | | | | | 50 | Slight |
| 4 | 4.0 | 1.0 | 5 | 1.5 | 40° | 3.75 | 300 | 24 | Slight |
| 5 | 4.0 | 1.0 | 5 | 1.5 | 50° | 3.75 | 300 | 24 | None |
| 6 | 3.0 | 1.0 | | 1.0 | 50° | 2.80 | Poured | 24 | None |

which were carried out on the specimens. In the table, what is meant by the "Flange height as coupled" is the effective length of the flange 20 as measured from the peripheral surface of the tubular packing 19 when the support 13 of the plug-receiver 11 is inserted into a support 14 of plug-blades 12 and the flange 20 is flexed into its final shape.

As apparent from Table 1, water leakage can be prevented for a long period of time by increasing the flange height and the number of flanges. On the other hand, the force necessary for separating one support from the other support increases with the number of flanges; for instance, the force is about 1 Kg for three flanges, while the force is about 1.5 Kg for five flanges. Thus, it is preferable to select the dimensions and the number of flanges 20 by experiments. The aforesaid force for support separation also varies depending on the material of the flange; for instance, the force is about 2 Kg for isobutylene-isoprene rubber of hardness 40°, while the force is about 3 Kg for the same rubber of hardness 50°.

Judging from the result of various tests, good watertightness can be achieved under the following conditions; namely, the flange height of 1.5 to 6 mm, the flange thickness of 0.5 to 1.5 mm, the chamfering radius at the flange peripheral edge of up to 2 mm, the interflange spacing of three quarters of the flange thickness or larger, and the flange height of 0.1 to 1 mm larger than the height of that surface which the outer periphery of the flange engages when the two supports are coupled. When isobutylene-isoprene rubber is used, its hardness should preferably be 35° to 60°, and the suitable number of the flanges per tubular packing is not greater than 8.

As far as the separation of the two supports and the degree of watertightness are concerned, the dimensions of the flanged packing and the number of flanges per packing are closely related to each other, so that various manufacturing conditions should be modified depending on the application thereof.

Figure 2:
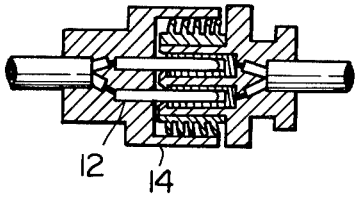
FIG. 2 is a sectional view, illustrating the coupled state of a plug, including plug-blades and a support thereof, and a receptacle, including a plug-receiver and a support thereof.

FIG. 2 illustrates another embodiment of the present invention, which is a watertight connector comprising, in combination, the plug-receivers 11 of FIG. 1 and plug-blades 12. The diameter of the inner peripheral surface of the support 14 of the plug-blades 12 is smaller than the outer diameter of the flange 20 by 0.4 mm. With the combination of FIG. 2, the force necessary for separating the two coupled supports was about 2 Kg in the case of using isobutylene-isoprene rubber of hardness 40°, and the force was about 3 Kg in the case of using the same rubber of hardness 50°. When the support 13 is going to be inserted into the support 14, the air between the bottom of the support 14 and the extreme left flange 20, as seen in FIG. 2, is gradually compressed and discharged to the outside while bending the flanges 20 to the right in succession, so that the coupling can easily be accomplished. Upon completion of the air discharge, the outer periphery of each flange is tightly urged against the inner surface of the support 14, as being arcuately flexed, and the high watertightness is established.

When the connector, which is provided with the watertight means of the present invention, is dipped in water, the water pressure in the space between the extreme right flange 20, as seen in FIG. 2, and the bottom of the support 13 acts to force the extreme right flange 20 to the left, as seen in the figure, and that flange 20 is urged against the inner surface of the support 14 more tightly.

To separate the two supports, the flange 20 must move in the opposite direction to the movement at the time of coupling, so that a separating force of considerable magnitude, e.g., a force of 2 to 3 Kg, is required. Thus, it is not possible that the coupled supports are very easily separated due to false operation or vibration.

Figure 3:
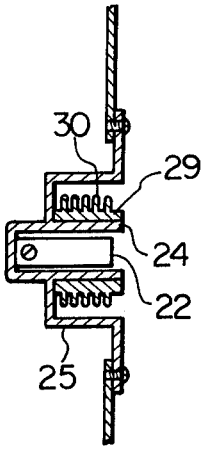
FIG. 3 is a sectional view, illustrating a plug having plug-blades and a support thereof provided with a watertight means according to the present invention.

FIG. 3 illustrates a watertight receptacle of flush type, in which the support of plug-receiver 22 comprises an inner support 24 and an outer support 25 which is integrally formed with the inner support and disposed outside thereof. A tubular packing 29 is secured to the outer peripheral surface of the inner support 24 by adhesive. Annular flanges 30 are formed on the outer periphery of the tubular packing 29 in the same manner as the flanges 20 of the tubular packing 19.

Figure 4:
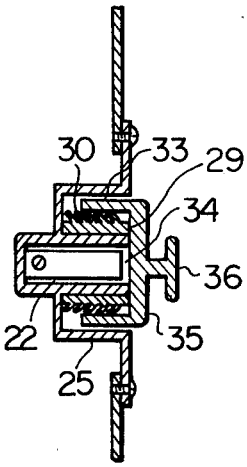
FIG. 4 is a sectional view, illustrating the coupled state of the plug of FIG. 3 and a receptable blind cover engageable with the plug.

As shown in FIG. 4, a receptacle blind cover can be mounted in the flush type receptacle of FIG. 3, so as to cause the cover to engage the outer edges of the flanges 30 within the outer support 25. The receptacle blind cover consists of a cylindrical portion 33 whose inside diameter is slightly smaller than the outer diameter of the flange 30, and a cover portion 35 which closes one end of the cylindrical portion. The cover portion has a grip 36 for facilitating the handling thereof. When the receptacle is not used, the cylindrical portion of the receptacle blind cover is loosely inserted into the outer support 25 of the receptacle, so as to fit the flanges 30 of the tubular packing 29 within the inside space 34 of the cylindrical portion of the receptacle blind cover. In this manner, the function of blindly covering the receptacle and the function of watertight closing are simultaneously fulfilled.

In the embodiments, as described in the foregoing, the flanged tubular packing is secured to the outer peripheral surface of either the receptacle support or the plug support, but it is apparent that the same watertight function can be achieved by securing the flanged tubular packing to the inner peripheral surface of that support which is to be coupled with the aforesaid outer peripheral surface.

I claim:

1. A watertight means for an electric plug-receptacle coupling, the electric plug and the receptacle having an axially extending support surface, and the support surfaces facing each other to define therebetween an annular space having a radius and each having an end, the support surface ends being axially spaced from each other, the watertight means consisting of a tubular packing between the support surface ends and secured to one of the support surfaces, the packing comprising a series of more than two flanges extending radially into contact with the other one of the support surfaces and having a radius larger than the radius of the annular space, and all the flanges in contact with the other support surface being arcuately flexed by the other support surface in a direction from the end of the one support surface towards the end of the other support surface.

2. The watertight means of claim 1, wherein the flanges are integral with the tubular packing.

3. The watertight means of claim 1, wherein the electric plug is a male plug member having the one support surface and defining recess means for receiving plug blades, and the receptacle is a female member carrying the plug blades, the receptacle member having the other support surface, the other support surface surrounding the one support surface.

4. The watertight means of claim 1, wherein the electric plug is a male electric plug receiver having the one surface, and the receptacle is a blind cover therefor having the other support surface, the other support surface surrounding the one support surface.

* * * * *